United States Patent [19]

Jones

[11] Patent Number: 4,813,500

[45] Date of Patent: Mar. 21, 1989

[54] EXPENDABLE DIAMOND DRAG BIT

[75] Inventor: Kenneth W. Jones, Kingwood, Tex.

[73] Assignee: Smith International, Inc., Newport Beach, Calif.

[21] Appl. No.: 109,980

[22] Filed: Oct. 19, 1987

[51] Int. Cl.[4] ..... E21B 10/46; E21B 10/60

[52] U.S. Cl. ..... 175/329; 175/379; 175/393; 175/411; 175/421

[58] Field of Search ..... 175/329, 330, 379, 393, 175/381, 409, 411, 412, 413, 421, 327

[56] References Cited

U.S. PATENT DOCUMENTS

| | | | |
|---|---|---|---|
| 1,522,593 | 1/1925 | Pickin | 175/413 X |
| 2,003,144 | 5/1935 | Graham, Jr. | 175/412 X |
| 2,342,931 | 2/1944 | Forhine | 175/379 |
| 2,357,835 | 9/1944 | Leissler | 175/421 X |
| 3,298,451 | 1/1967 | Eckel et al. | 175/421 X |
| 3,768,581 | 10/1973 | Rederon | 175/329 |
| 3,885,637 | 5/1975 | Veprintsev et al. | 175/329 |
| 3,938,599 | 2/1976 | Horn | 175/329 |
| 4,221,270 | 9/1980 | Vezirian | 175/329 |
| 4,234,048 | 11/1980 | Rowley | 175/329 |
| 4,246,977 | 1/1981 | Allen | 175/329 |
| 4,253,533 | 3/1981 | Baker, III | 175/329 |
| 4,265,324 | 5/1981 | Morris et al. | 175/329 |
| 4,290,498 | 9/1981 | Triplett et al. | 175/409 X |
| 4,303,136 | 12/1981 | Ball | 175/329 |
| 4,325,439 | 4/1982 | Vezirian | 175/329 |
| 4,334,585 | 6/1982 | Upton | 175/329 |
| 4,350,215 | 9/1982 | Radtke | 175/329 |
| 4,440,247 | 4/1984 | Sartor | 175/393 |
| 4,475,606 | 10/1984 | Crow | 175/410 |
| 4,494,618 | 1/1985 | Radtke | 175/393 |
| 4,499,958 | 2/1985 | Radtke | 175/329 |
| 4,505,342 | 3/1985 | Barr et al. | 175/329 |
| 4,533,004 | 8/1985 | Ecer | 175/329 |
| 4,538,690 | 9/1985 | Short, Jr. | 175/329 |
| 4,538,691 | 9/1985 | Dennis | 175/393 |
| 4,539,018 | 9/1985 | Whanger et al. | 51/295 |
| 4,719,979 | 1/1988 | Jones | 175/329 |

FOREIGN PATENT DOCUMENTS

| | | | |
|---|---|---|---|
| 308189 | 8/1971 | U.S.S.R. | 175/393 |
| 630399 | 10/1978 | U.S.S.R. | 175/410 |
| 870671 | 10/1981 | U.S.S.R. | 175/393 |
| 907214 | 2/1982 | U.S.S.R. | 175/393 |

*Primary Examiner*—Hoang C. Dang

*Attorney, Agent, or Firm*—Robert G. Upton

[57] ABSTRACT

A fishtail type drag bit having abradable cutter blades attached to a body of the bit is disclosed. A multiplicity of axially aligned tubes are welded together to form a blade each blade being sustantially parallel with an axis of the bit body. Each tube of the blade contains an annulus of a diamond cutter material matrix. The center of the annulus forms a fluid conduit that communicates with a fluid plenum chamber formed by the body of the bit. The cutting edge of the diamond matrix therefore, is always immediately adjacent the fluid nozzle regardless of the degree of blade erosion during operation of the bit in a subterranean formation.

5 Claims, 2 Drawing Sheets

FIG. 4
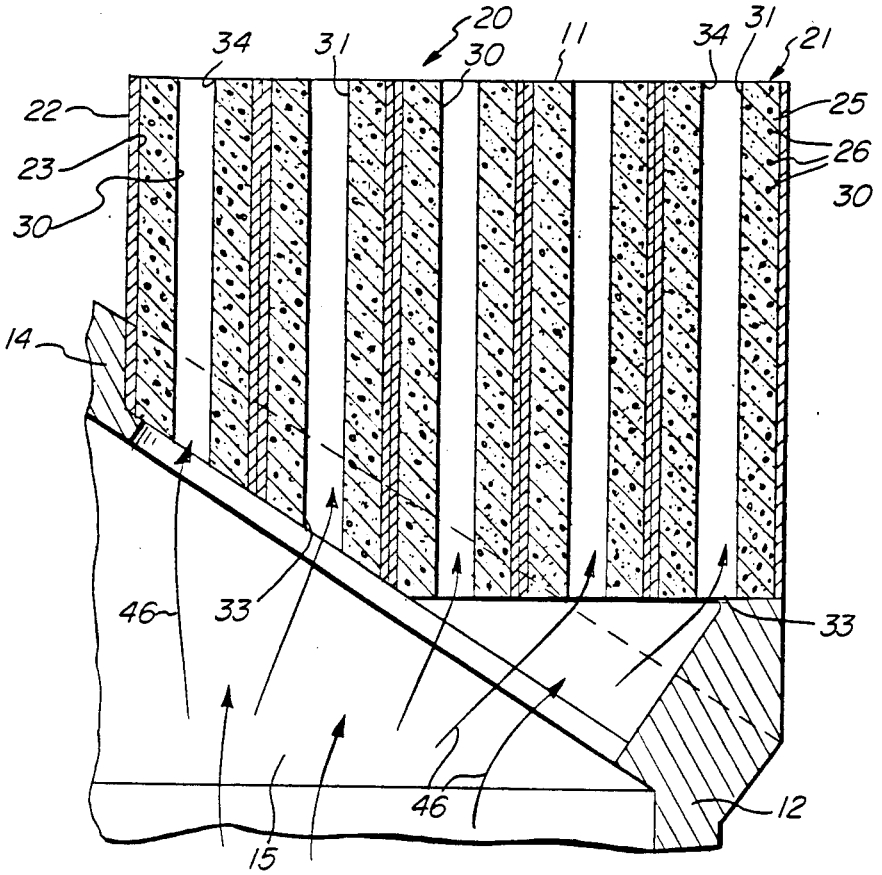
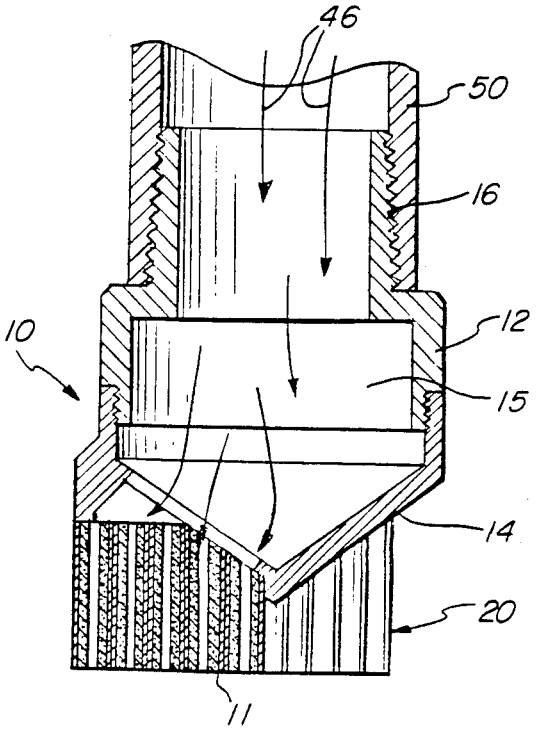
FIG. 5

EXPENDABLE DIAMOND DRAG BIT

CROSS-REFERENCE TO RELATED APPLICATION

This application is related to U.S. Pat. No. 4,719,979, entitled Expendable Diamond Drag Bit, filed Mar. 24, 1986 and issued Jan. 19, 1988.

BACKGROUND OF THE INVENTION

1. Field of the Invention

The present invention is directed to drag bits having diamond or other hard cutter inserts. More particularly, the present invention is directed to blade-type drag bits incorporating diamond cutter inserts wherein, even though the blades erode during drilling in a formation, the diamond inserts nevertheless remain sharp and effective for attacking the formation.

2. Brief Description of the Prior Art

Drill bits or rock bits are well known in the art. Such drill bits are used for drilling in subterranean formations when prospecting for oil, water or minerals. The term "drag bit", generally speaking, designates a drill bit which has no rotating cones and which is rotated either from the surface through a string of drill pipes and drill collars (drill string) or by a suitable "downhole" motor. In contrast, rotary cone bits have one or more journals each of which carries a freely rotatable drill bit cone. Regardless of whether rotary cone bits or drag bits are used for drilling in a formation, drilling fluid or "drilling mud" is continuously circulated from the surface through the drill string down to the drill bit, and up to the surface again. As is well known, the circulating mud serves several important functions; these include continuous cooling of the drill bit and removal of the downhole cuttings which are generated by the drilling action.

Several types of drag bits are known in the art; these include fishtail bits, auger bits, as well as more "conventional" drag bits which lack relatively large extending blades but nevertheless may be provided with "hard" diamond, tungsten-carbide, or the like cutter inserts. Blade-type rotary drag bits are also known in the art which have diamond or other "hard" cutter inserts imbedded or affixed to the blades. Such blade-type bits are described, for example, in U.S. Pat. Nos. 4,440,247 and 4,499,958.

Generally speaking, one serious problem encountered in the prior art in connection with diamond insert studded drag bits is overheating of the diamond inserts due to inadequate flushing and cooling action of the drilling fluid. As is known, heat, unless dissipated through adequate cooling with drilling fluid, may convert the diamond of the inserts into graphite with a resulting loss of hardness and drilling power. Another serious problem encountered in connection with diamond studded drag bits involves loss of the diamond cutters from the bit. Yet another problem, which is especially serious in the field of blade-type bits is the relatively rapid wear or erosion of the blades of the bit. The erosion, of course, can also rapidly lead to loss of diamond cutters from the blades.

The prior art has attempted to solve the foregoing problems by providing drilling fluid outlet passages or holes adjacent to the diamond inserts in the drag bits, and by appropriately choosing the configuration of the drag bit body so as to optimize the flushing and cooling action of the drilling fluid on the cutter inserts. The drill bits described in U.S. Pat. Nos. 4,221,270, 4,234,048, 4,246,977, 4,253,533, 4,303,136, 4,325,439, 4,334,585, 4,505,342, and 4,533,004 provide examples of these efforts in the prior art.

Still further descriptions of drill bits, which comprise a general background to the present invention, may be found in U.S. Pat. Nos. 3,768,581, 3,938,599, 4,265,324, 4,350,215, 4,475,606, 4,494,618, 4,538,690, 4,538,691, and 4,539,018. A general overview of "Rock-Bit Design, Selection, and Evaluation" may be found in a paper bearing the above title. This paper is a revised reprint of a presentation made by H. G. Bentson at the Spring meeting of the Pacific Coast District, API Division of Production, Los Angeles, May, 1956, printed in August, 1966.

In summary, the foregoing patent disclosures provide evidence of intense efforts in the prior art to develop rock bits in general, and diamond cutter insert studded drag bits in particular, which have prolonged working lives and improved wear characteristics. In spite of the foregoing efforts, there is definitely still need and room for improvement in this field. Specifically, there is need in the art for blade-type drag bits having diamond cutter inserts, retained in the blade with an adequate means to cool the diamond blades even as a major portion of the blade is eroded or worn away during drilling. The present invention provides such blade-type drag bits.

SUMMARY OF THE INVENTION

It is an object of the present invention to provide a blade-type drag bit which has improved operating life and wear characteristics.

It is another object of the present invention to provide a blade-type drag bit having diamond cutter inserts which are retained in the blades and continue to remain exposed for operative engagement with the formation to be drilled, even as the blade wears or erodes during drilling.

It is still another object of the present invention to provide a blade-type drag bit having diamond cutter inserts wherein flow of drilling fluid or drilling mud to the inserts is optimized.

It is yet another object of the present invention to provide an integral fluid exit nozzle at the cutting plane of each column of diamond cutter material. The exit nozzles being formed concentrically within the conduit of diamond material contained within a metal jacket forming each of the cutter blades of the drag bit.

The foregoing objects or advantages are attained by a blade-type drill bit which has a pin end adapted for being removably attached to a drill string, and a bit body attached to the pin end. The bit body has an interior cavity in fluid communication with the drill string to receive a supply of drilling fluid contained within the drill string. At least one drill blade is attached to the bit body. The blade has a leading edge configured to contact the formation during drilling. A plurality of conduits or apertures in fluid communication with the interior cavity of the bit body are disposed in the blade. Each of the conduits is formed by a wall of diamond cutting material disposed along substantially the entire length of the blade and encapsulated within a framework of metal. The conduits terminate in fluid discharge ports formed by the diamond cutting edge of the diamond cutting material forming the leading edge of the blade. The diamond cutting material forming the the fluid conduit and encapsulated within the framework of metal is disposed in such a configuration that, as the blade erodes, and as small pieces of diamond are lost during drilling, additional parts of the diamond cutting material become exposed to the formation to effectively drill the same.

Moreover, as the blades erode, since the nozzle is an integral part of the eroding cutting edge of the diamond material, optimum cooling for the newly exposed diamond cutters is assured for each column of diamond material making up each blade of the bit.

The foregoing and other objects and advantages can be best understood, together with further objects and advantages, from the ensuing description taken together with the appended drawings wherein like numerals indicate like parts.

BRIEF DESCRIPTION OF THE DRAWINGS

FIG. 4 is a partial cross-sectional view of a cutter blade, taken through 4—4 of FIG. 2, and FIG. 5 is a cutaway cross-sectional view of a fishtail type drag bit threadably engaged with the end of a drill string.

DESCRIPTION OF THE PREFERRED EMBODIMENTS AND BEST MODE FOR CARRYING OUT THE INVENTION

Figure 1:
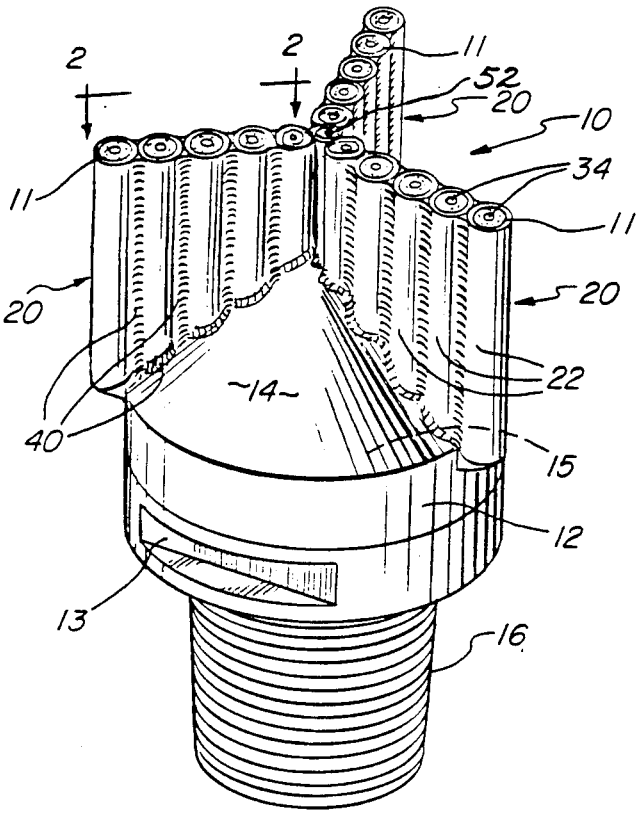
FIG. 1 is a perspective view of a first preferred embodiment of the blade-type drilling bit of the present invention.

FIG. 1 is a perspective view of a preferred embodiment of a fishtail type diamond drag bit, generally designated as 10. The fishtail bit is comprised of a bit body 12, a dome portion 14 and a pin end 16. Tool slots 13 are formed in the body to facilitate removal of the bit from an end of a drill string 50 (FIG. 5). A plenum chamber or cavity 15 is formed within the bit body 12, the dome portion 14 confines one end of the plenum chamber, the opposite end of the chamber communicating with an opening in the pin end 16 of the bit body 12. Cutter blades, generally designated as 20, are attached to the dome portion 14 to form the cutting end 11 of the bit 10. Each of the cutting blades 20 are, for example, fabricated from a multiplicity of metallic cylindrical tubes 22. Each of the tubes are metallurgically bonded or welded together along their outer peripheries to form each of the blades 20.

Each tube 22 forms a mold for a diamond cutting material, generally designated as 24. The diamond containing matrix 25, for example, is comprised of tungsten carbide particles 27 mixed with diamond chips or particles 26. The matrix is bonded together, for example, with a nickel-copper based binder material 28. Other types of tungsten carbide binders may be selected, such as nickel-chrome-boron, nickel-chrome-iron or a copper zinc without departing from the scope of this invention. The inside wall 23 of metallic tube 22 forms a mold for the diamond matrix cutting material 24. The internal fluid conduit 30 is formed by the diamond matrix cutting material 24.

Figure 2:
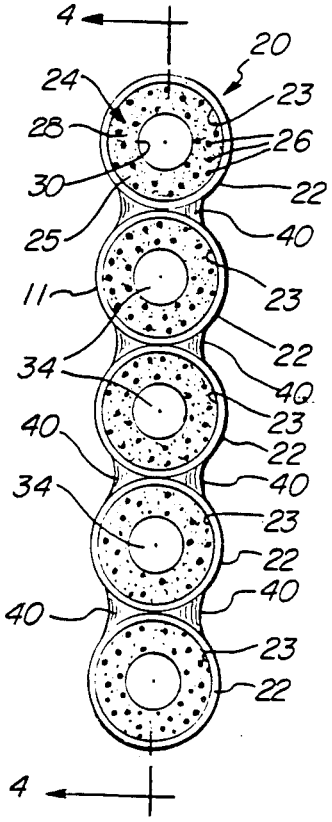
FIG. 2 is an end view of a blade of the first preferred shown in 2—2 of FIG. 1.
Figure 3:
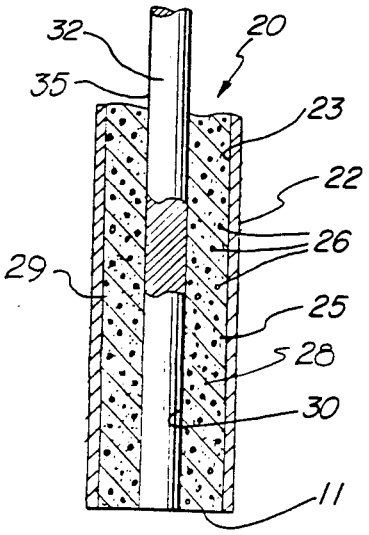
FIG. 3 is a partial cross-sectional view of an individual concentric diamond tube with a graphite rod centrally positioned, the rod being drilled out after the diamond matrix material is infiltrated.

FIG. 2 illustrates, for example, five metallic or steel tubes 22 joined together to form a blade 20. Each tube is welded to an adjacent tube as indicated by weld 40. Each tube has formed therein, an annulus of diamond matrix material 24 confined within inner wall 23 of steel tube 22. The inner conduit or channel 30 concentric within the annulus of diamond cutting material is formed by inserting, for example, a graphite rod 32 (FIG. 3) that is held concentrically within each tube 22. The diamond matrix material 24 initially is in powdered form. The powdered material is poured within the annulus 29 formed between the inner wall 23 of tube 22 and the outer surface 35 of graphite rod 32. After the diamond matrix material is infiltrated with a binder within a furnace at a temperature of from 1800° to 2150° F. for a period of time of about one hour the graphite rod 32 is drilled out of the diamond matrix cutting material 24. The conduit or channel 30 is then formed within the diamond cutting material 24. Other types of temperature resistant rods may be used for the conduit forming rod as long as it is removable after the matrix is infiltrated.

In a specific example, a seven and seven-eighths inch, three-bladed fishtail bit, such as that shown in FIG. 1, would have the following parameters. Each blade 20 would comprise five tubes 22 about four inches long, welded together at 40. Each of the blades 20 would then be welded to a single center tube 52. The tube 22 would have the following dimensions; the tube is three-quarters of an inch outside diameter with a one-sixteenth inch wall thickness. The tube inside diameter 23 is five-eighths of an inch. The tube is fabricated from a high strength alloy, such as forty-one thirty steel. The inside dimension of the fluid conduit 30 is three-eighths of an inch leaving a wall thickness of diamond cutting material 24 of of one-eighth of an inch. The center rod 32 used to form fluid channel 30 is three-eighths inch in diameter and is fabricated from graphite. The diamond cutting material 24 is a matrix of tungsten carbide powder 28 and diamond particles 26. The diamond particles may be synthetic unicrystalline diamond or polycrystalline diamond, such as that produced by Megadiamond of Provo, Utah, a wholly owned subsidiary of Smith International, Incorporated, or the diamond particles may be natural diamond. The tungsten carbide powder and diamond particles are infiltrated with a copper, nickel based brazing alloy binder in a furnace for about one hour at a temperature of from 1800° to 2150° F. The infiltrate binder melts into the tungsten carbide and diamond to form the matrix 24 around the centrally positioned graphite rod 32. After the diamond material 24 is formed, the rod 32 is drilled out forming the fluid conduit as heretofore described (not shown).

Each of the diamond cutting tubes making up the blade 20 may, alternatively be completed prior to welding a multiplicity of tubes together to form the blade 20 of bit 10. Of course, any number of tubes may be welded together to form a blade of any radial length depending upon the "gage" diameter of the bit. The gage determines the diameter of the borehole in the subterranean formation.

In addition, with reference again to FIG. 1, where two or more blades 20 make up the cutting end 11 of bit 10, it is desirable to radially position each cutter tube 22 making up the blade 20 so that it overlaps a "kerf" left by the cutter tubes 22 of a leading blade 20. In other words, each blade 20 cuts a path of concentric radially varied circles that will leave ridges or kerfs that are removed by a following blade. The cutter tubes 22 in the following blade 20 are so radially positioned to cut concentric, radially varying circles that overlap or cut the ridges formed by the leading blade (not shown).

With reference now to FIG. 4 and 5, each blade 20 is metallurgically bonded or welded into the dome 14 of the bit body 12. An entrance opening 33 to conduit 30 communicates with the plenum or cavity 15 formed within the bit body 12. Fluid or "mud" directed through the drill string 50, enters the cavity 15 and is directed to the entrance 33 to conduit 30 the fluid exiting through discharge port or nozzle 34 at the cutting end 11 of the blades 20. The diamond cutter material 24 consists of a matrix of tungsten carbide material 25, diamond particles 26 and a metallic binder 28 The diamond matrix cutting material 24 forms an abradable material that is continuously self-sharpening as the cutting blades 20 are worn down along cutting edge 11 of the blade 20 during operation of the fishtail bit in a borehole. Since an annulus of diamond cutting material 24 defines the conduit 30 as well as the nozzle 34, as each of the blades is worn down the nozzle opening 34 remains immediately adjacent the cutting edge 11 of the abrading diamond matrix 24, thereby providing coolant or fluid where it is most needed, i.e. adjacent to the cutting plane 11 of each blade working in a borehole bottom. Since the fluid exit plane nozzle 34 and the cutting edge 11 of the diamond matrix material is the same, a high velocity of coolant and flushing fluid is assured adjacent the formation being cut.

Moreover, as the bit blade 20 erodes during use, the fluid flow remains at a constant high velocity since the exit plane of the fluid nozzle and the cutting edge of the diamond material are one and the same. The fluid nozzle 34 being formed by the concentric ring of the diamond matrix cutting material 24 automatically locates the flushing fluid at the very place where it is most needed, i.e. immediately adjacent the rock being cut.

With reference now specifically to FIG. 5, after each steel encased diamond matrix cutter is formed and the center graphite rod 32 is drilled out, the self-contained cutters may then be welded together at junction 40 in a "stack" forming each of the blades 20. Each blade, for example, may consist of five parallel tubes welded or otherwise metallurgically bonded together weld 40. Three of the completed blades may, for example, then be positioned about 120 degrees, one from the other and welded into the dome 14 of the drag bit body 12. The axis of each of the matrix diamond cutter tubes making up the blade 20 is substantially aligned or parallel with an axis of the drag bit body 12. A pin end 16 of the bit body 12 is threadably engaged with a drill string 50. Each of the hollow diamond cutting tubes 22 communicate with a fluid plenum chamber 15 formed within the drill bit body as shown in FIGS. 4 and 5. Fluid or mud is pumped down the drill string 50 into the plenum chamber 15 and from there is accelerated out of the nozzle 34 at the end of the cutting blades 20. As heretofore mentioned, the narrow gap formed between the formation borehole bottom and the cutting edge 11 of the circumferentially oriented diamond cutters assures a higher velocity of fluid from nozzles 34 to remove detritus from the borehole bottom while cooling and cleaning the diamond cutters 24 formed on the leading edge of each blade 20.

It would be obvious to vary the length of the blades as well as the internal configuration of each of the blades. For example, each blade could be a single wall of diamond cutting material surrounding an internal fluid channel. Moreover, each of the tubes containing the annulus of diamond cutting material 24 could be metal jackets forming a square or rectangular cross section without departing from the teachings of this invention. Any geometric shape that leaves an adequate annulus to be filled with a diamond tungsten carbide matrix such as that herein before described and still provides an acceptable fluid conduit would fall within the scope of this invention.

It will of course be realized that various modifications can be made in the design and operation of the present invention without departing from the spirit thereof. Thus, while the principal preferred construction and mode of operation of the invention have been explained in what is now considered to represent its best embodiments, which have been illustrated and described, it should be understood that within the scope of the appended claims, the invention may be practiced otherwise than as specifically illustrated and described.

What is claimed is:

1. A drag type drill bit for drilling subterranean formations comprising:

a bit body forming a first pin end and a second cutting end, said pin end being adapted to be attached to a drill string, said body further forming an interior cavity in fluid communication with a supply of fluid contained within said drill string, and at least one blade attached to said bit body at said second cutting end, said blade forming a leading edge configured to contact said formation, said blade further forming a multiplicity of conduits in fluid communication with the interior cavity of the bit body, said conduits being formed by a wall of cutting material disposed along a length of the blade, said cutting material is comprised of hard diamond like particles said cutting material is dispersed in an abradable matrix metal of tungsten carbide with a metallic binder selected from the group consisting of nickel-copper, nickel-chrome-boron, nickel-chrome-iron and copper zinc, the conduits being terminated in a multiplicity of fluid discharge ports formed by said cutting material forming said leading edge of said blade said cutting material forming each of said fluid conduits is encased within a metallic jacket, a multiplicity of said jackets being aligned substantially parallel with an axis of said bit body, said multiple jackets being metallurgically bonded together to form said blade, the blade being exposed for drilling the formation in the leading edge of the blade with its longitudinal axis substantially perpendicular to the direction of erosion of the blade, as the cutting blade erodes exposing new cutting material during the drilling operation, the discharge ports continues to supply said fluid immediately adjacent said cutting material to assure cooling and cleaning of said cutting edge as well as detritus removal from a borehole bottom formed in said subterranean formation.

2. The invention as set forth in claim 1 wherein said metallic jackets are steel cylindrical tubes welded together to form said blade, each tube having encased therein, a concentric annulus of said cutting material, an inner wall formed by said cutting material forming said conduit, the conduit being in fluid communication with said interior cavity of the bit body.

3. The invention as set forth in claim 1 wherein said hard diamond like particles are natural diamond.

4. The invention as set forth in claim 1 wherein said hard diamond like particles are synthetic unicrystalline diamond.

5. The invention as set forth in claim 1 wherein said hard diamond like particles are synthetic polycrystalline diamond.

* * * * *